United States Patent [19]

LaPointe

[11] 4,438,973

[45] Mar. 27, 1984

[54] SWIVEL CHAIR WITH BRAKE

[75] Inventor: Larry P. LaPointe, LaSalle, Mich.

[73] Assignee: La-Z-Boy Chair Company, Monroe, Mich.

[21] Appl. No.: 290,068

[22] Filed: Aug. 4, 1981

[51] Int. Cl.[3] ..... A47C 3/02; A47C 3/00

[52] U.S. Cl. ..... 297/349; 297/263; 248/425

[58] Field of Search ..... 297/349, 270, 263; 248/418, 425

[56] References Cited

U.S. PATENT DOCUMENTS

| | | | |
|---|---|---|---|
| 133,233 | 11/1872 | Lewis | 297/270 |
| 475,019 | 5/1892 | McKean | 297/349 |
| 1,693,770 | 12/1928 | Wilson | 248/418 |
| 2,625,983 | 1/1953 | Slyter et al. | 297/263 |
| 2,764,223 | 9/1956 | Mischke | 248/418 |
| 3,726,560 | 4/1973 | Page | 297/349 |

*Primary Examiner*—Francis K. Zugel

[57] ABSTRACT

A swivel rocker has a stop-swivel brake mechanism, including a seat spring operated lever, that is actuated when a chair occupant lifts his weight from the seat.

17 Claims, 5 Drawing Figures

SWIVEL CHAIR WITH BRAKE

BRIEF SUMMARY OF THE INVENTION

This invention relates to swivel chairs, including rocker chairs that swivel, and its purpose is to provide means to control swivel movement of the chair. This purpose is accomplished by a brake mechanism that is energized by energy stored in the seat spring system and which is activated as a chair occupant lifts his weight from the seat of the chair.

DRAWINGS

FIG. 3 is a vertical section through the chair of FIG. 1 with the upholstery material removed and parts broken away;

DESCRIPTION OF THE INVENTION

Figure 1:
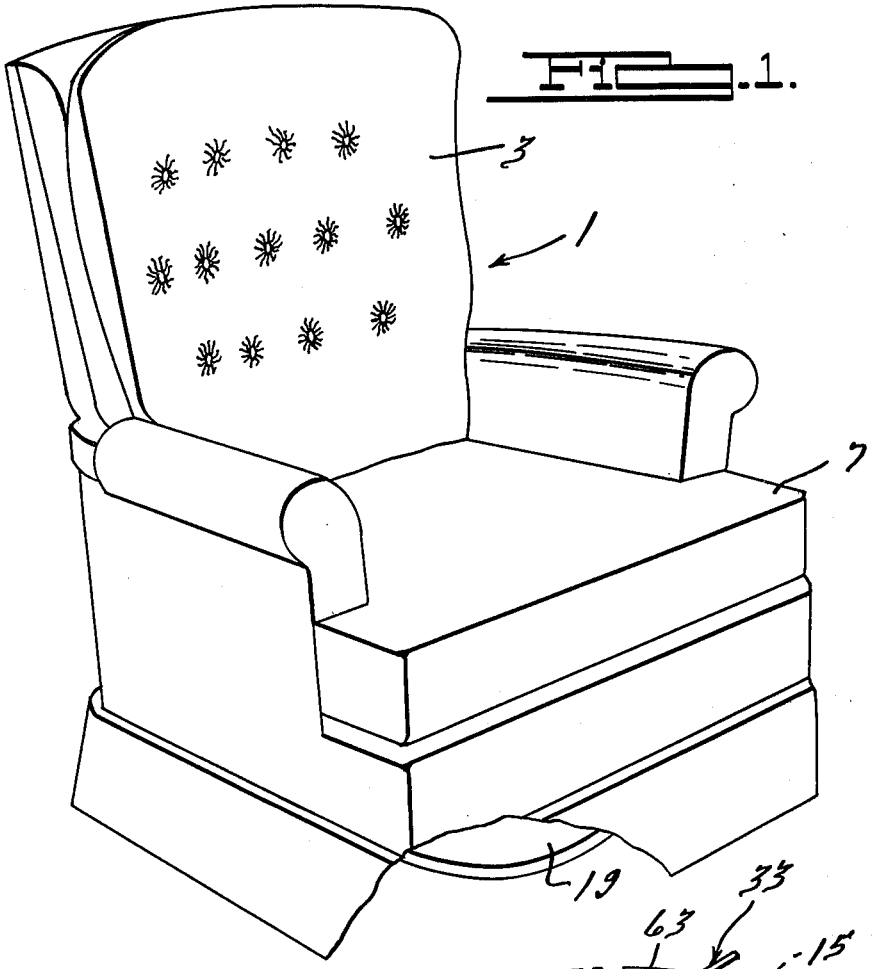
FIG. 1 is a perspective view of an upholstered swivel rocker chair, partly broken away to show the base, with which the invention may be used.

The swivel rocker chair 1 includes upholstery 3 attached to a seat frame 5 and upholstery 7 attached to a back frame 9 which is supported separately on the seat frame by way of side rods 11 on the frame 5. The seat frame 5 includes an upper portion that has a pair of convex-faced rocker blocks 13 secured on the bottom thereof and these rock upon a lower portion in the form of flat, horizontal side rails 15 on a substantially flat support member 17. The upper and lower portions are suitably connected through coil spring mechanisms 18 of a known type which are secured to the sides of the blocks 13 and the rails 15. They yieldably resist rocking and return the chair seat and back to a predetermined upright position. The support member 17, and thus the chair, is supported for rotary or swivel movement on an enlarged, flat, round base plate 19 by a swivel mechanism 21 of suitable type. The known mechanism 21 illustrated comprises an upper plate 23 secured to the bottom of member 17 and a lower plate 25 secured to the top of base 19, the two plates having registering circular grooves containing trapped ball bearings 27 to enable low friction rotary movement about the vertical axis of the ball bearing tracks. This vertical axis of rotation is located at the center of the base 19 and along the midplanes of the seat frame 5 but is offset toward the back of member 17, as can be seen in FIG. 3.

The structure so far described permits the chair seat and back to rock and swivel on the base 19. The invention provides brake means 31 to prevent rotation of the chair unless it is occupied. The brake means 31 uses as a braking force spring pressure stored in the seat spring system 33 that is secured to the upper part of the seat frame 5. The spring system 33 may be one of various constructions used in chair seats, since all have the common characteristics of being resiliently biased upwardly to create a yieldably top crown surface to provide seating comfort. The particular spring assembly illustrated is of the zig-zag spring type and includes a series of transversely separated spring elements 35 having substantially horizontal seat defining portions 37 extending from front to back of the seat and vertically extending support portions 39 at the front and back ends of seat portions 37 that are anchored to rails 41 of the seat frame 5 (FIG. 3). The individual spring elements 35 are tied to each other by an outer rectangular relatively rigid frame rod 41, which defines the outer edge of the seat, and by transversely extending fabric covered wires 43. In this way the spring portions 37 and wires 43 provide a resilient yet comfortable seating surface resiliently supported by portions 39 which spring press the surface upwardly when it is deflected downwardly toward the base 19. This spring pressure is used to operate the brake mechanism 31.

Figure 2:
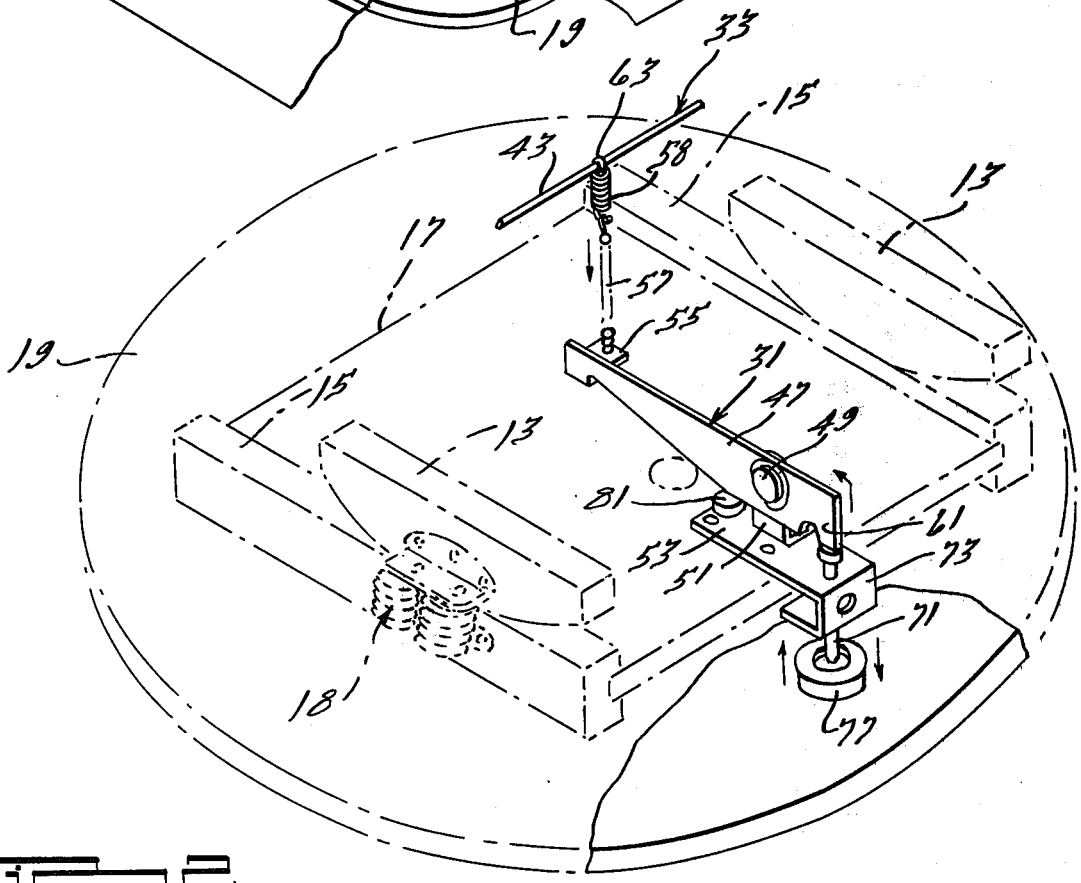
FIG. 2 is a perspective view, somewhat schematic, of the swivel brake mechanism of this invention.
Figures 2, 5:
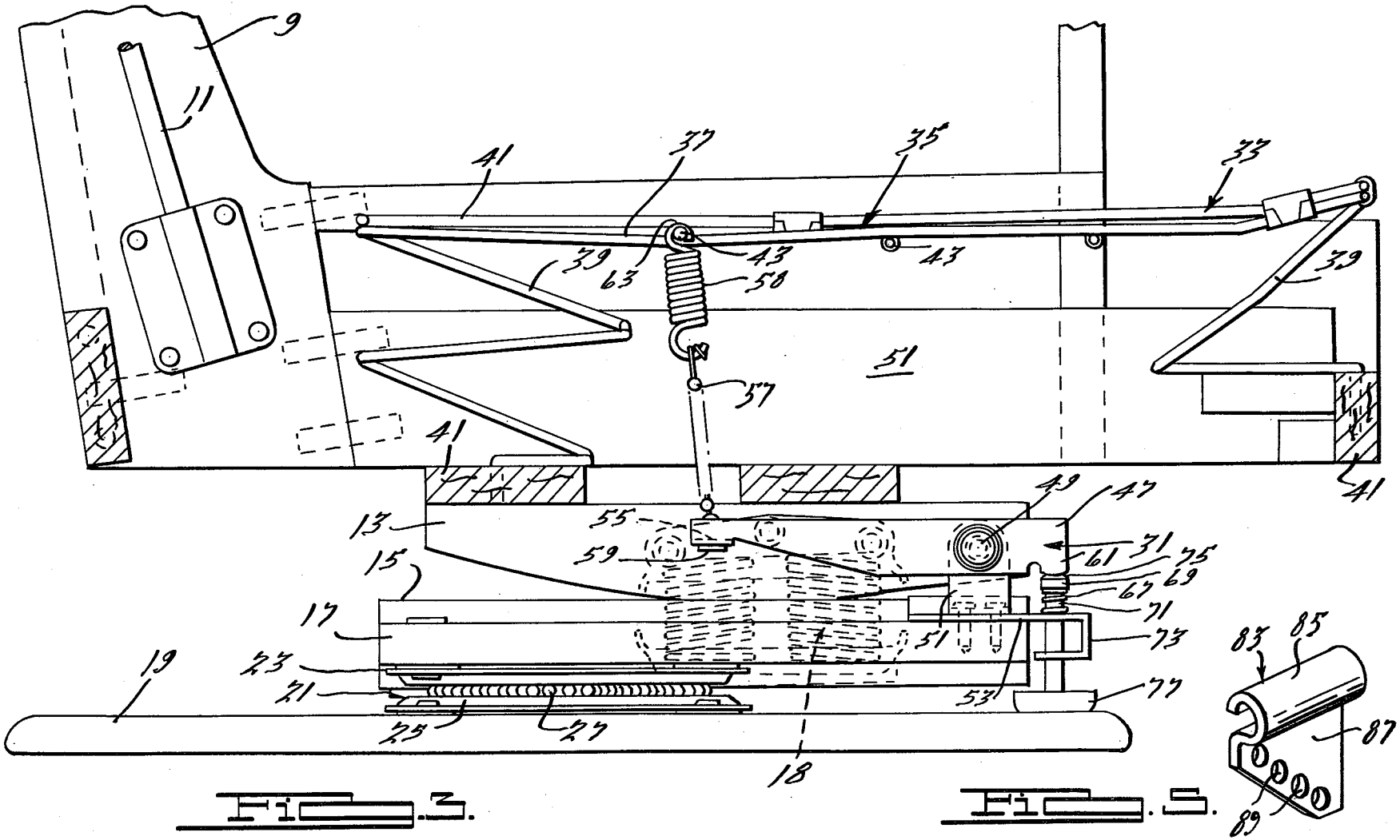
FIG. 5 is a perspective detail view of a bracket that may be used to vary the load in the force applying member.

The mechanism 31 comprises a force multiplying member in the form of a horizontally extending rocker arm lever 47 that is pivotally mounted at 49 on a vertical bracket 51. Bracket 51 is fixed on the top of a horizontal J-shaped bracket 53 which is secured to the top of support member 17. The back end of the lever 47 has a horizontal flange 55 with an opening therein to receive the bottom end of a flexible chain-like tension means 57 which has a fitting 58 that engages the bottom of the flange 55 so that the chain means 57 can serve as a force applying means to apply only an upwardly directed vertical load to the lever 47. When such a load is applied to the back end of lever 47, a nose portion 61 at the front end of the lever is forced downwardly as the lever rotates clockwise on its pivot 49. In order to apply the up load to the back end of the lever, the top end of the chain means 57 is pivotally attached at 63 around a tube 65 that is placed over one of the wires 43 forming a part of the resilient seat surface, the connection being forward of the axis of rotation but close to the midplane of the chair. Preferably, the chain means includes both a chain element and a coil spring element 58, the top end of which is looped around the wire 43. The chain means is attached at 63 when the wire 43 is deflected downwardly and is therefore under spring pressure to return to a higher position. This pressure is an upward tensile load in the chain means and its magnitude depends upon the amount of initial deflection of the wire 43 or seating surface. For example, about 20–25 pounds load may be on the chain means when the seat is not occupied. Such load would actually separate the coils of spring 58 (such separation not being shown in FIG. 3) which provides an additional energy storage means to furnish an up load on lever 47. This may be readily varied through use of a bracket 83 (FIG. 5) which has a tubular top section 85 that may be placed around and crimped to wire 43 and a downwardly extending web 87 with vertically separated holes 89 in it to receive the attachment hook at the top end of the spring 58 (or a chain snap at the top of the chain element) whereby the spring 58 (or chain element) may be pre-stretched (or pre-loaded) different amounts depending upon the hole used. The bottom hook of the spring receives a loop at the top of the chain element and may, if desired, have a one-way washer (such as a Tinnerman nut) pressed on it as shown to resist slip-off of the chain.

The initial deflection of spring system 33 is less than the deflection produced by weight of a person sitting in the chair. Thus, when the chair is occupied the load in the chain means 57 is cancelled and it collapses. The lever 47 can then move in response to force applied to it by a coil spring 67. The spring 67 presses down against the top of bracket 53 and up against the head 69 of a plunger 71. The plunger extends through a pair of aligned guide openings in the J-shaped end 73 of the bracket 53 and is pressed by spring 67 against the bottom face 75 of the end 61 of the lever so that the pressure of the spring 67 acts upwardly against the lever tending to pivot it in a counterclockwise direction, as seen in FIG. 3.

The plunger 71 serves as a carrier for a brake pad 77 which is affixed to its bottom end and is engageable with the top surface of the base 19. The coil spring 67 resiliently urges it up and out of contact with the base but an upward force in chain 57 will apply sufficient downward force to overcome it, such force being magnified because the pivot 49 is located much closer to plunger 71 than to flange 55. Thus, spring pressure in the seat spring system 33 when the chair is unoccupied is transmitted into a braking force on the pad 77 that is sufficiently large to strongly resist swiveling of the chair on the base. Since the swivel 21 is on the centerline of the base 19, the brake pad 77 swings on a fixed radius about this centerline in an annular path close to the outer edge of the base so that it can be operated automatically to hold the chair in any rotary position. Thus, an annular area at the outer periphery of the base plate serves as a braking surface to cooperate with the brake pad 77.

Figure 4:
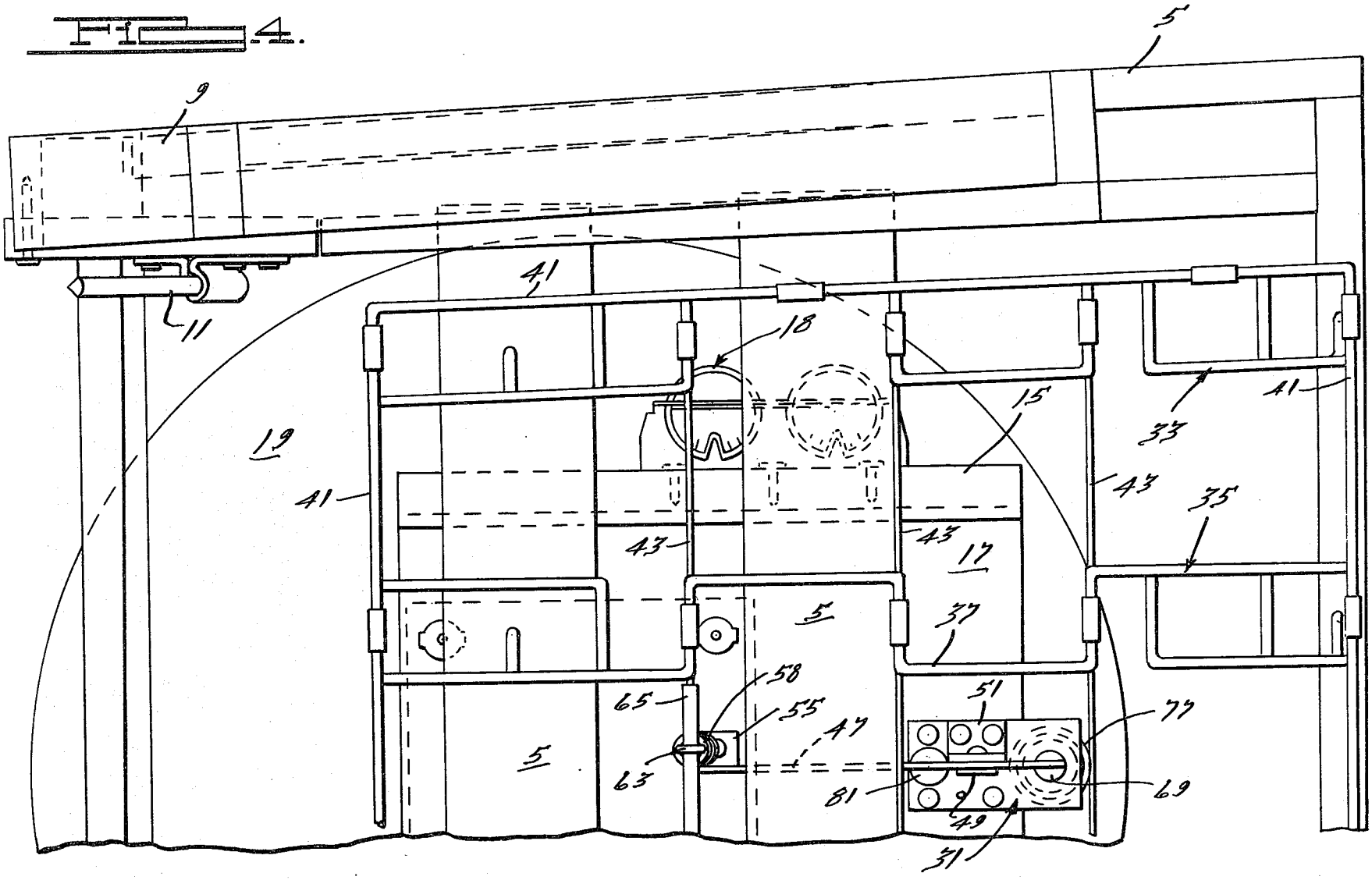
FIG. 4 is a plan view of the structure shown in FIG. 3.

In use, when a person occupies the chair 1 the seat springs, including wire 43 and tube 65 (FIG. 4), are depressed and chain means 57 is collapsed enough to avoid interference with rocking of the chair. When the occupant starts to leave the chair, regardless of angular, swiveled position, the force applied to chain means 57 by the spring system will immediately force the brake pad 77 to forcibly engage the base 19 thereby resisting rotation of the support member 17 and seat frame 5 and the entire chair. The chair will remain in the non-rotary condition until sufficient weight is applied to the springs to collapse chain means 57 and allow spring 67 to lift the pad 77. A bumper 81 (omitted in FIG. 3) may be used if desired to limit the motion of lever 47 due to spring 67.

Modifications may be made in the structure shown without departing from the spirit and scope of the invention.

I claim:

1. A chair comprising a seat frame, a base for the chair, chair support means swively mounting the frame on the base, and brake means acting between the support means and the base to resist swiveling of the chair when it is unoccupied a seat spring system on said seat frame providing a yieldable top crown seating surface, said brake means being connected to and energized by force of the spring system released as it moves to provide said top crown seating surface when a chair occupant lifts his weight from the seat.

2. A chair as set forth in claim 1 wherein said base includes a braking surface, said brake means including a braking pad capable of engagement with said braking surface throughout the range of angular movement of the seat frame as it swivels on the base.

3. A chair as set forth in claim 2 wherein said brake means includes a braking pad carrier having reciprocating motion, said braking pad being mounted on said carrier, first spring means urging the carrier in one direction, and second spring means urging the carrier in the opposite and brake operating direction.

4. A chair comprising a seat frame, a base for the chair, chair support means swively mounting the frame on the base, and brake means acting between the support means and the base to resist swiveling of the chair when it is unoccupied, said base including a braking surface, said brake means including a braking pad capable of engagement with said braking surface throughout the range of angular movement of the seat frame as it swivels on the base, said brake means including a braking pad carrier having reciprocating motion, said braking pad being mounted on said carrier, first spring means urging the carrier in one direction, and second spring means urging the carrier in the opposite and brake operating direction comprising a seat spring system mounted on the seat frame and force multiplying means connecting the seat spring system to the carrier whereby the seat spring system serves as said second spring means.

5. A chair as set forth in claim 4 including a force applying means connected to said seat spring system and to said force multiplying means so that the seat spring system applies force to the force applying means when the chair is unoccupied and said force is applied to the force multiplying means to move said carrier against said first spring means and press the braking pad against said braking surface.

6. A chair as set forth in claim 5 wherein said force multiplying means comprises a lever mounted on said seat frame and operatively connected at one end to said force applying means and at the other end to said carrier and serving to multiply the spring system force and to overcome said first spring means and apply operating force to said carrier.

7. A chair as set forth in claim 6 wherein said base comprises a relatively flat plate and an annular portion adjacent its outer periphery provides said braking surface, said carrier comprising a plunger having vertical motion, said braking pad being mounted on the bottom of said plunger, said seat frame including a support member, a guide bracket for guiding said plunger mounted on said seat frame support member, said first spring means acting between said guide bracket and said plunger to urge said plunger in an upward direction and disconnect the braking pad from the braking surface.

8. A chair as set forth in claim 7 including a pivot bracket mounted on said seat frame support member, said force multiplying means comprising said lever being pivoted between its ends on said pivot bracket, one end of said lever being operatively engageable with said plunger and the other end being connected to said force applying means.

9. A chair as set forth in claim 8 wherein said force applying means holds said seat spring system in a deflected condition but the deflection thereof is less than the deflection that occurs when the weight of a chair occupant is applied to said seat spring system.

10. A chair as set forth in claim 9 wherein force applying means is flexible and capable of transmitting tensile forces only.

11. A chair as set forth in claim 10 including means engageable by the lever to limit movement thereof by said first spring means.

12. A chair as set forth in claim 10 wherein said seat frame includes a rockable portion carrying said seat spring system, said rockable portion being rockably mounted on said seat spring support member.

13. A chair as set forth in claim 10 wherein said force applying means comprises a chain means.

14. A chair as set forth in claim 13 wherein said chair means includes a chain element and a coil spring and force of unoccupied deflection of the spring system is stored in said coil spring and applies tension to said chain element.

15. A chair as set forth in claim 10 including means for connecting the chain means to the spring system at various vertical points whereby differing preloads may be applied to the chain means and seat spring system.

16. A chair as set forth in claim 15 wherein said last mentioned means comprises a bracket for attachment to the spring system and having vertically spaced connection holes to receive said chain means and be connected thereto.

17. A chair as set forth in claim 14 wherein said seat frame includes a rockable portion carrying said seat spring system, said rockable portion being rockably mounted on said seat spring support member.

* * * * *